US007374263B2

(12) United States Patent
Hosono

(10) Patent No.: US 7,374,263 B2
(45) Date of Patent: May 20, 2008

(54) LIQUID EJECTING APPARATUS

(75) Inventor: Satoru Hosono, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 245 days.

(21) Appl. No.: 11/345,343

(22) Filed: Feb. 2, 2006

(65) Prior Publication Data

US 2006/0192797 A1 Aug. 31, 2006

(30) Foreign Application Priority Data

Feb. 3, 2005 (JP) ..... P2005-027497

(51) Int. Cl.
*B41J 25/308* (2006.01)
*B41J 29/38* (2006.01)
*B41J 2/045* (2006.01)

(52) U.S. Cl. ..... 347/8; 347/10; 347/68; 347/70

(58) Field of Classification Search ..... 347/8
See application file for complete search history.

(56) References Cited

U.S. PATENT DOCUMENTS 5,988,784 A 11/1999 Takemura et al.
6,733,102 B2 * 5/2004 Hosono ..... 347/8
2003/0085973 A1 * 5/2003 Yokouchi ..... 347/101

FOREIGN PATENT DOCUMENTS

| | | | |
|---|---|---|---|
| EP | 1 174 276 | A1 | 1/2002 |
| EP | 1 199 170 | A2 | 4/2002 |
| EP | 1 475 235 | A1 | 11/2004 |
| JP | 10-193587 | A | 7/1998 |
| JP | 2002-225250 | | 8/2002 |
| JP | 2003-145760 | A | 5/2003 |
| JP | 2004-299348 | A | 10/2004 |

* cited by examiner

*Primary Examiner*—Matthew Luu
*Assistant Examiner*—Jannelle M Lebron
(74) *Attorney, Agent, or Firm*—Sughrue Mion, PLLC

(57) ABSTRACT

A liquid ejecting head includes a nozzle formation face with a nozzle; a pressure chamber communicated with the nozzle; and a pressure generator changing pressure in the chamber so as to eject liquid from the nozzle. An adjuster adjusts a distance between the nozzle formation face and the target medium so as to be at least a first distance, and a second distance that is longer than the first distance. A driving signal generator generates a driving signal that includes a first pulse having at least a first expansion element and a first ejecting element, and a second pulse having at least a second expansion element and a second ejecting element. A pulse supplier selectively supplies a pulse to the pressure generator. The pulse supplier selects the first pulse when the distance is the first distance, and selects the second pulse when the distance is the second distance.

5 Claims, 10 Drawing Sheets

LIQUID EJECTING APPARATUS

BACKGROUND OF THE INVENTION

The present invention relates to a liquid ejecting apparatus of an inkjet printer and so on, and more particularly, to a liquid ejecting apparatus which drives a pressure generating element using a driving signal including various kinds of ejecting pulses in an ejecting period such that dots having different sizes can be formed on a target object.

A liquid ejecting apparatus includes a liquid ejecting head which can eject liquid as a liquid droplet, and ejects various kinds of liquid from the liquid ejecting head. As a representative example of the liquid ejecting apparatus, there is an image record device of an inkjet printer and so on, which includes, for example, an inkjet record head (hereinafter, referred to as record head) as a liquid ejecting head and ejects/impacts liquid ink as an ink droplet from a nozzle orifice of the record head onto a target object such as a record sheet to form a dot and perform record. In addition, recently, the liquid ejecting apparatus applies to various kinds of manufacturing apparatuses such as a color filter manufacturing apparatus of a liquid crystal display and so on, in addition to the image record device.

In the inkjet printer (hereinafter, referred to as printer), for example, a driving signal, in which various kinds of ejecting pulses having different amounts of the ejected ink are connected to each other in series, is generated, and the ejecting pulses of the driving signal are selectively supplied to a pressure generating element such as a piezoelectric vibrator to drive the pressure generating element, thereby forming dots having different sizes on the target object such as the record sheet. For example, in a printer disclosed in JP-A-10-193587, a single driving signal is formed by a first waveform and a third waveform which are ejecting pulses for forming a middle dot and a second waveform and a fourth waveform which are ejecting pulses for forming a small dot, the waveform according to ejecting data is selected from the driving signal to be supplied to the pressure generating element, thereby forming the dot having a desired size. In addition, the printer disclosed in JP-A-10-193587 is configured by supplying all the first waveform and the third waveform to the pressure generating element to form a large dot.

Accordingly, in this kind of printer, when relatively large amount of ink is ejected onto the record sheet, such as full print, a cockring phenomenon that the record sheet is bent by the absorption of the large amount of ink may be caused. When the cockring is generated, a distance from the nozzle orifice of the record head (a nozzle formation face that is formed with the nozzle orifice) to the record surface of the record sheet (paper gap or platen gap) is reduced. Accordingly, the flight distance of the ink droplet is changed and thus record unevenness is generated or the record sheet contacts the record head and thus the record sheet is contaminated.

Since the record sheet called a dedicated sheet has an ink receiving layer and the ink is absorbed into the ink receiving layer, the cockring is not easily generated. Accordingly, when the record is performed using the dedicated sheet, the paper gap is reduced to some extent. On the contrary, when a general sheet which does not have the ink receiving layer is used, since the paper itself absorbs the ink, the cockring tends to increase. Thus, generally, when the general sheet is used in the printer, the paper gap is set to be larger than that of the dedicated sheet in consideration of looseness of the paper due to the cockring.

However, if the paper gap is large, since the flight time for ejecting and impacting the ink droplet becomes longer, the flight bending of the ink droplet is apt to be affected. As the result, a position in which a dot is formed is deviated from an adequate position and thus image quality is deteriorated. Furthermore, the ink droplet may extend in an ejecting direction by an ejecting force such that the tail thereof is separated, thereby generating a minute ink particle called satellite ink droplet. At this time, if the paper gap is large, the satellite ink droplet is not impacted onto the target object and floats in the air as mist. If the mist floats in the air, the inside of the printer is contaminated.

In order to solve the above-mentioned problems, a method of suppressing an ejecting speed (flight speed) of the ink droplet and suppressing the ink droplet from extending in the ejecting direction such that the satellite ink droplet is not generated may be considered. However, if the flight speed of the ink droplet is suppressed, since the flight time becomes longer while the vicinity of the nozzle orifice is wet or shape unevenness is apt to be affected, the flight bending becomes larger. As the result, impact accuracy is deteriorated and thus the image quality is deteriorated. Particularly, if the dedicated sheet is used, since a user requires higher image quality of the record image, the deterioration of the image quality must be suppressed, if possible.

SUMMARY

It is therefore an object of the invention to provide a liquid ejecting apparatus which appropriately uses ejecting pulses in accordance with a distance from the nozzle orifice to the target object such that higher impact accuracy can be ensured if the distance is short and a failure due to the mist can be prevented if the distance is long.

In order to achieve the object, according to the invention, there is provided a liquid ejecting apparatus comprising:

a liquid ejecting head, comprising:

a nozzle formation face, formed with a nozzle orifice;

a pressure chamber, communicated with the nozzle orifice, and adapted to contain liquid therein; and a pressure generator, operable to cause pressure change in the pressure chamber so as to eject the liquid in the pressure chamber from the nozzle orifice to a target medium as a liquid droplet;

an adjuster, operable to adjust a distance between the nozzle formation face and the target medium so as to be at least a first distance and a second distance that is longer than the first distance;

a driving signal generator, operable to generate a driving signal that includes:

a first pulse having at least a first expansion element for causing the pressure generator to expand the pressure chamber and a first ejecting element for causing the pressure generator to contract the pressure chamber to eject a liquid droplet having a prescribed volume; and a second pulse having at least a second expansion element for causing the pressure generator to expand the pressure chamber and a second ejecting element for causing the pressure generator to contract the pressure chamber to eject a liquid droplet having the prescribed volume; and a pulse supplier, operable to selectively supply the first pulse and the second pulse to the pressure generator, wherein the first pulse is configured such that the first ejecting element is applied to the pressure generator when a meniscus of the liquid is located at a first position that is closer to the pressure chamber than a reference position after the first expansion element is applied to the pressure generator, the second pulse is configured such that the second ejecting element is applied to the pressure generator when the meniscus is located at a second position that is farther from the pressure chamber than the first position after the second expansion element is applied to the pressure generator, and the pulse supplier selects the first pulse when the distance is the first distance, and selects the second pulse when the distance is the second distance.

With this configuration, since the liquid droplet ejected by the first pulse selected by the pulse supplier when the distance is the first distance has a relatively high flight speed, it is difficult to generate flight bending and thus it is possible to ensure higher impact accuracy when the distance is the first distance. In addition, since the liquid droplet ejected by the second pulse selected by the pulse supplier when the distance is the second distance has a flight speed slower than that of the liquid droplet ejected by the first pulse, it is difficult to generate a satellite liquid droplet. Thus, when the distance is the second distance, it is possible to suppress mist from being generated and thus to prevent a failure due to the mist.

The second position may be identical with the reference position.

Furthermore, the reference position represents the position of the meniscus which stops in the state that the pressure generator does not operate and in the state that the nozzle orifice and the liquid in the vicinity of the nozzle orifice is refreshed due to the flushing operation or the like. In addition, the reference position is slightly displaced vertically.

The driving signal may commonly include the first pulse and the second pulse within a unit cycle thereof.

The driving signal generator may generate the first pulse after the second pulse when the distance is the first distance, and generate the first pulse prior to the second pulse when the distance is the second distance.

In this case, since the liquid droplet ejected by the second pulse has the flight speed slower than that of the liquid droplet ejected by the first pulse and thus the flight time thereof becomes longer, the liquid droplet is impacted at a position which is spaced apart from the ejected position in the movement direction of the liquid ejecting apparatus. On the contrary, since the liquid droplet ejected by the first pulse has the flight speed faster than that of the liquid droplet ejected by the second pulse and the flight time thereof becomes shorter, the liquid droplet is impacted at a position close to just below the ejected position. Accordingly, in the state that the distance is the first distance, when the liquid droplet is ejected by sequentially applying the second pulse and the first pulse to the pressure generator, since the impact positions of the liquid droplets are adjacent to each other, it is possible to form a dot with better accuracy. Moreover, in the state that the distance is the second distance, when the liquid droplet is ejected by sequentially applying the first pulse and the second pulse, since a satellite liquid droplet attached to the liquid droplet ejected by the first pulse is absorbed into the liquid droplet ejected by the second pulse, it is possible to suppress the mist from being generated.

The first pulse may further include a first holding element for holding a state of the pressure chamber expanded by the first expansion element for a first time period, and the second pulse may further include a second holding element for holding a state of the pressure chamber expanded by the second expansion element for a second time period that is longer than the first time period.

DETAIL DESCRIPTION OF PREFERRED EMBODIMENTS

Hereinafter, an exemplary embodiment according to the present invention will be described with reference to the accompanying drawings. In addition, the below-mentioned embodiment, preferred examples of the present invention are variously defined, but the present invention is not limited to the examples if there is no a description which limits the present invention in the below-mentioned description. Furthermore, hereinafter, an inkjet printer (hereinafter, referred to as printer) illustrated in FIG. 1 is used as a liquid ejecting apparatus of the present invention.

Figure 1:
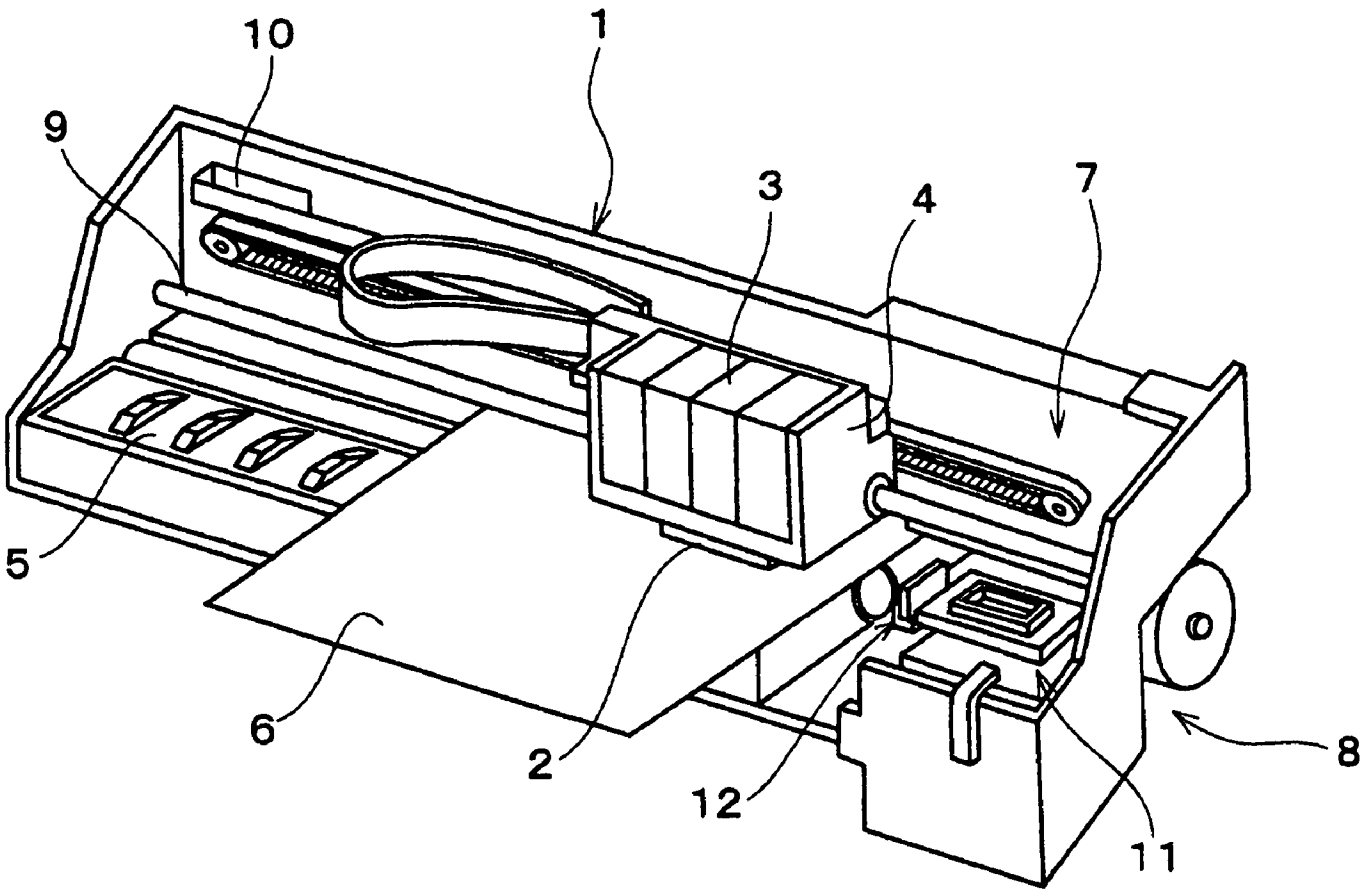
FIG. 1 is a perspective view illustrating a configuration of a printer.

As shown in FIG. 1, the printer 1 schematically includes a carriage 4 in which a record head 2 can be mounted as a liquid ejecting head and an ink cartridge 3 can be detachably mounted, a platen 5 provided below the record head 2, a carriage movement mechanism 7 which reciprocally moves the carriage 4 (record head 2) in a paper width direction of the record sheet 6 (a kind of target object), that is, a main scan direction, and a paper feed mechanism 8 which carries the record sheet 6 in a sub scan direction perpendicular to the main scan direction.

The carriage 4 is pivot-supported by a guide rod 9 which is provided over the main scan direction, and moves in the main scan direction along the guide rod 9 by the operation of the carriage movement mechanism 7. The position of the main scan direction of the carriage 4 is detected by a linear encoder 10, and the detected signal, that is, an encoder pulse, is transmitted to a control unit 41 (see FIG. 3) of a printer controller. Accordingly, the control unit 41 can control a record operation (ejecting operation) using the record head 2 while recognizing the scan position of the carriage 4 (record head 2), based on the encoder pulse of the linear encoder 10.

Figure 2:
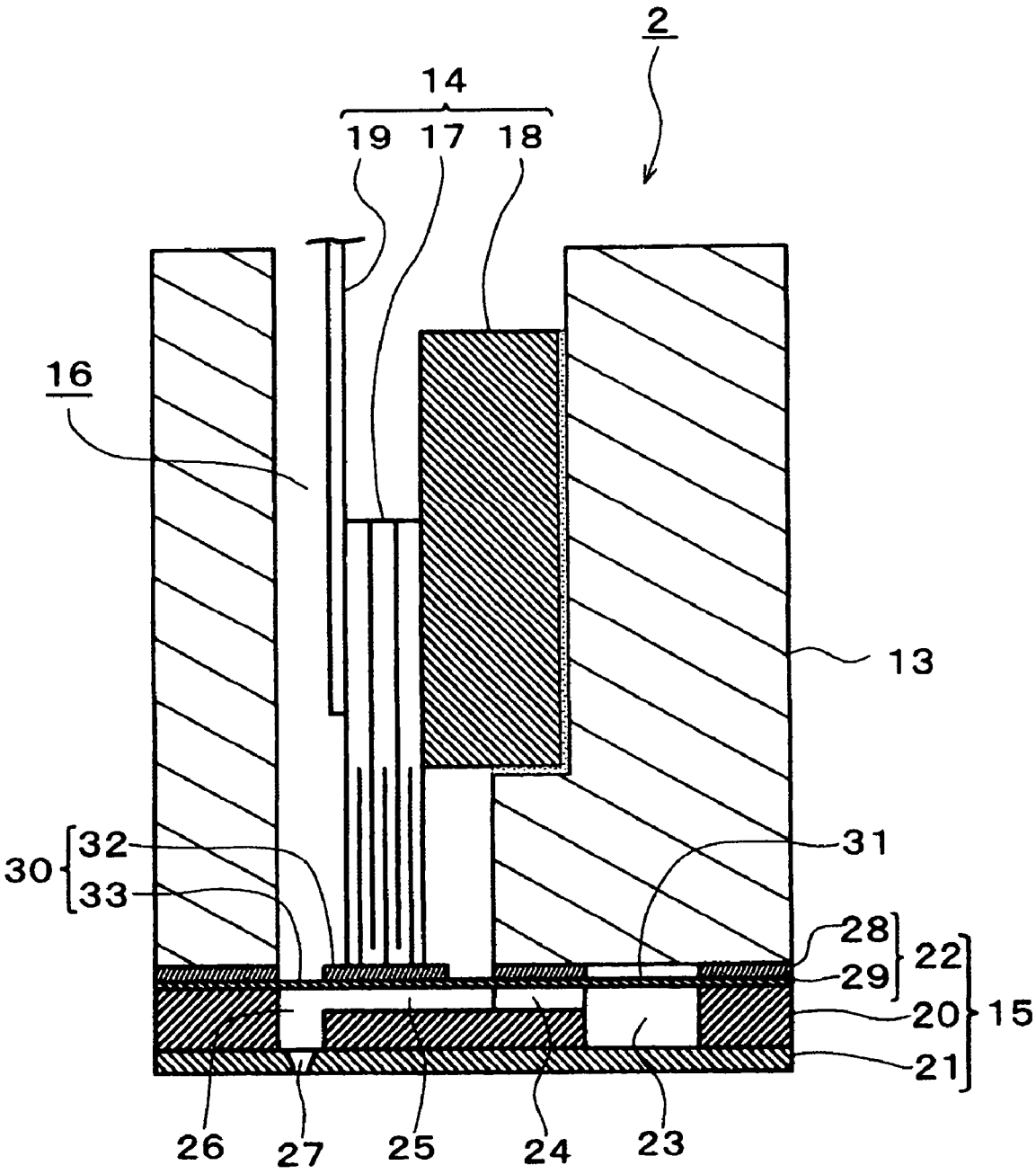
FIG. 2 is a cross-sectional view of main portions explaining a configuration of a record head.
Figure 3:
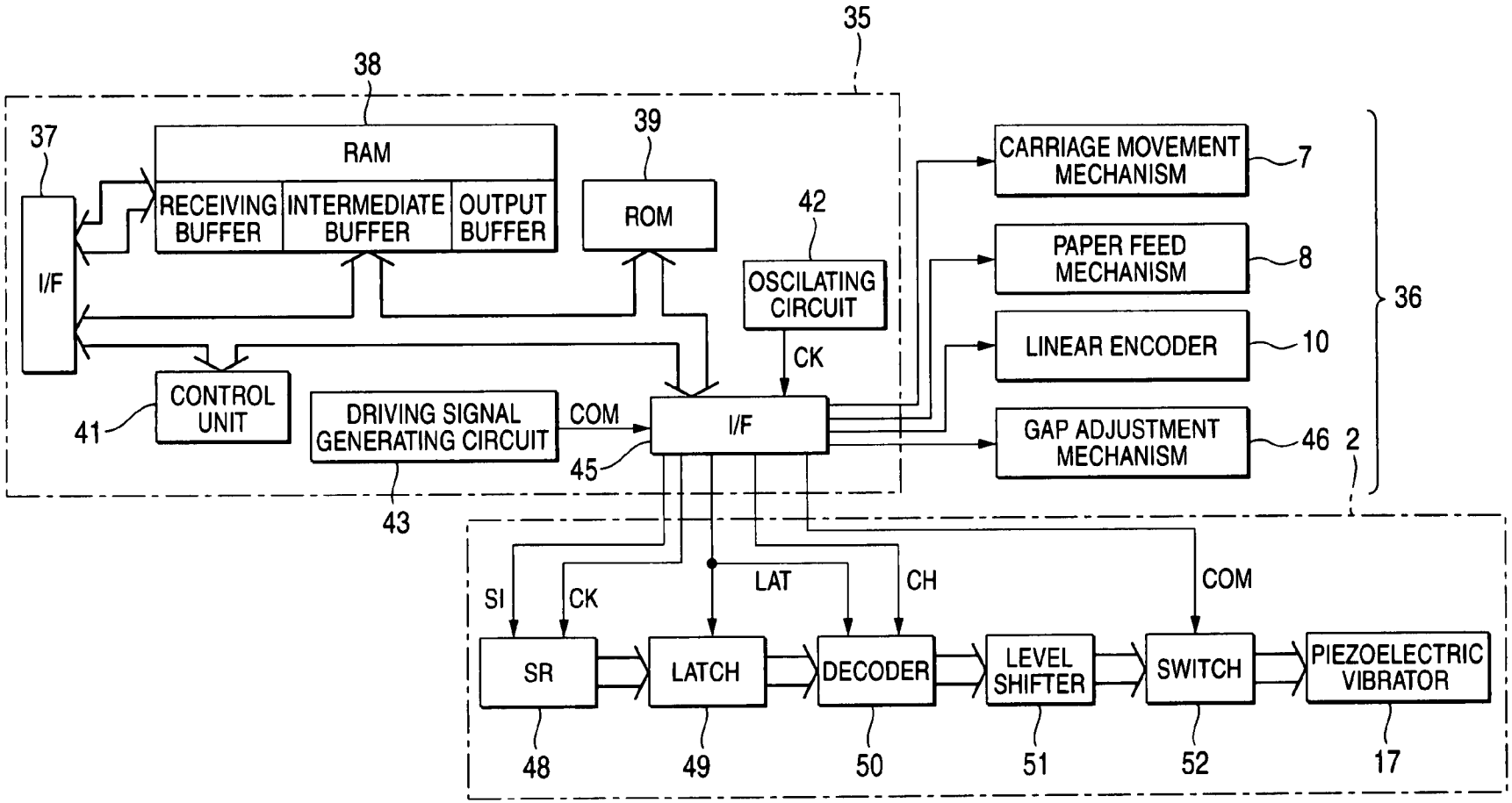
FIG. 3 is a block diagram illustrating an electrical configuration of the printer.

The guide rod 9 is provided with a gap adjustment mechanism 46 (see FIG. 3). The gap adjustment mechanism 46 includes a gap adjustment motor (not illustrated) and an eccentric cam, and drives the gap adjustment motor under the control of the control unit 41 to rotate the eccentric cam such that the guide rod 9 vertically moves. By the vertical movement of the guide rod 9, the carriage 4 moves in a direction which is close to or spaced apart from the platen 5, and thus a distance from a nozzle orifice 27 (see FIG. 2) formed in a nozzle surface (nozzle plate, or nozzle formation face) 21 of the record head 2 to the surface of the record sheet (hereinafter, referred to as paper gap) can be adjusted. In the present embodiment, the paper gap can be adjusted in accordance with the kind of the record sheet 6. For example, if the record object is a general sheet, the paper gap is adjusted to about 1.5 mm, and, if the record object is a dedicated sheet, the paper gap is adjusted to a range of 0.7 to 1.2 mm. In other words, in the general sheet, since cockring is apt to be generated, the paper gap is set to be relatively large (PG: large) in consideration of looseness due to the cockring. In the dedicated sheet, since the cockring is not apt to be generated, the paper gap is set to be smaller (PG: small) than that of the general sheet.

In an end region located at the outside (front right side of FIG. 1) of a record region in the movement range of the carriage 4, a home position which is a reference point of the scan is set. In the home position of the present embodiment, a capping member 11 for sealing the nozzle formation face (nozzle plate 21: see FIG. 2) of the record head 2 and a wiper member 12 for wiping the nozzle formation face are disposed. Furthermore, the printer 1 is configured to perform bidirectional record in which a character or an image is recorded on the record sheet 6 at the time of going in which the carriage 4 (record head 2) moves from the home position toward the opposite end and at the time of returning in which the carriage 4 returns from the opposite end to the home position.

As shown in FIG. 2, the record head 2 includes a case 13, a vibrator unit 14 received in the case 13, and a channel unit 15 adhered to the bottom (front end) of the case 13. The case 13 is made of, for example, epoxy resin, and is formed with a receiving space 16 for receiving the vibrator unit 14 therein. The vibrator unit 14 includes a piezoelectric vibrator 17 which functions as a kind of pressure generating element, a fixing plate 18 to which the piezoelectric vibrator 17 is adhered, and a flexible cable 19 for supplying a driving signal to the piezoelectric vibrator 17. The piezoelectric vibrator 17 is a lamination type which is manufactured by alternately laminating a piezoelectric layer and an electrode layer and dividing the laminated piezoelectric plate in a pectinate shape, and is a piezoelectric vibrator of a longitudinal vibration mode which can expand and contract in a direction perpendicular to the lamination direction.

The channel unit 15 is configured by adhering a nozzle plate 21 to one surface of the channel forming substrate 20 and adhering an elastic plate 22 to the other surface of the channel forming substrate 20. The channel unit 15 is provided with a reservoir 23, an ink supplying port 24, a pressure chamber 25, a nozzle communicating port 26, and a nozzle orifice 27. Furthermore, a series of ink channel from the ink supplying port 24 to the nozzle orifice 27 through the pressure chamber 25 and the nozzle communicating port 26 is formed in correspondence with the nozzle orifice 27.

The nozzle plate 21 is a thin metal plate such as stainless, in which a plurality of nozzle orifices 27 are formed in a row with a pitch corresponding to dot forming density (for example, 180 dpi). The nozzle plate 21 is formed with plural rows of nozzle orifices 27 (nozzle row), one nozzle row is composed of, for example, 180 nozzle orifices 27. In addition, in the present embodiment, the record head 2 is mounted with four ink cartridges 3 for storing ink of different colors (a kind of liquid in the present invention), that is, ink of four colors of cyan (C), magenta (M), yellow (Y), and black (k). Four nozzle rows are formed in the nozzle plate 21 in correspondence with the respective colors.

The elastic plate 22 has a double structure obtained by laminating an elastic film 29 on the surface of a support plate 28. In the present embodiment, the elastic plate 22 is made of a compound plate material including a stainless plate which is a kind of the metal plate as the support plate and a resin film laminated on the surface of the support plate 28 as the elastic film 29. The elastic plate 22 is provided with a diaphragm portion 30 for changing the volume of the pressure chamber 25. In addition, the elastic plate 22 is provided with a compliance portion 31 for sealing a portion of the reservoir 23.

The diaphragm portion 30 is manufactured by partially removing the support plate 28 by an etching process. In other words, the diaphragm unit 30 includes an island portion 32 to which the front end of the piezoelectric vibrator 17 is adhered and a thin elastic portion 33 for surrounding the island portion 32. The compliance portion 31 is manufactured by removing the support plate 28 of a region facing an opening surface of the reservoir 23 by the etching process, similar to the diaphragm portion 30, and functions as a damper for absorbing the pressure change of the liquid contained in the reservoir 23.

Furthermore, since the island portion 32 is adhered with the front end of the piezoelectric vibrator 17, the volume of the pressure chamber 25 can be changed by expanding and contracting the free end of the piezoelectric vibrator 17. The pressure change of the ink in the pressure chamber 25 is generated depending on the volume change. In addition, the record head 2 ejects the ink droplet from the nozzle orifice 27 using the pressure change.

As shown in FIG. 3, the printer 1 schematically includes a printer controller 35 and a print engine 36. The printer controller 35 includes an external interface (external I/F) 37 which receives print data from an external device such as a host computer, a RAM 38 which stores various kinds of data, a ROM 39 which stores a control routine for processing the various kinds of data, a control unit 41 which controls the respective elements, an oscillating circuit 42 which generates a clock signal, a driving signal generating circuit 43 which generates a driving signal supplied to the record head 2, and an internal interface (internal I/F) 45 which outputs ejecting data obtained by developing the print data in each dot or the driving signal to the record head 2.

The control unit 41 converts the print data received from the external device through the external I/F 37 into the ejecting data corresponding to a dot pattern and outputs the ejecting data to the record head 2 through the internal I/F 45, in addition to the control of the respective elements. In addition, as described above, the control unit 41 controls the gap adjustment mechanism 46 to adjust the paper gap in accordance with the kind of the record sheet 6 which is the record object (target object). At this time, information representing the size of the paper gap is output to a decoder 50 of the record head 2 through the internal I/F 45 as PG information, and is used as control information at the time of forming a middle dot. Furthermore, the PG information is used as control information at the time of forming a large dot. This will be described later in detail. Moreover, the kind of the record sheet 6 which is the record object can be obtained by, for example, the control information transmitted from the host computer.

Figure 4A:
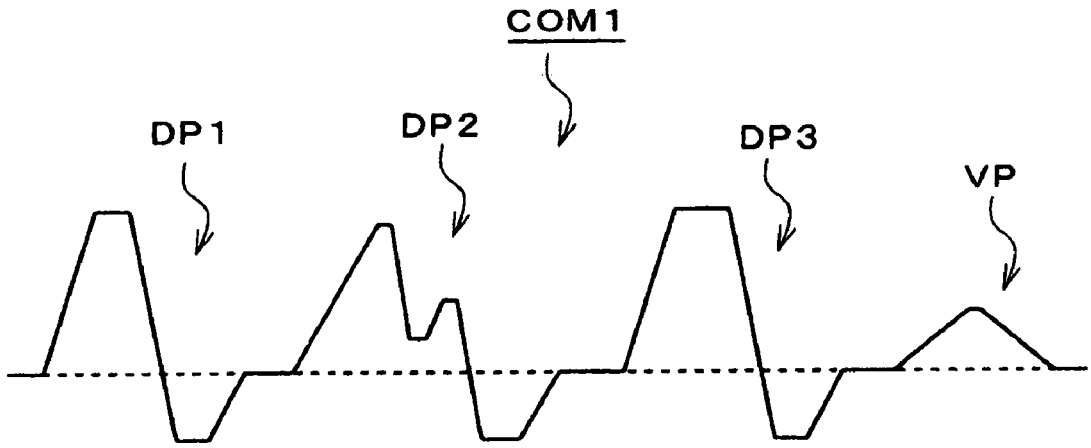
FIGS. 4A and 4B are waveform views explaining configurations of driving signals.
Figure 4B:
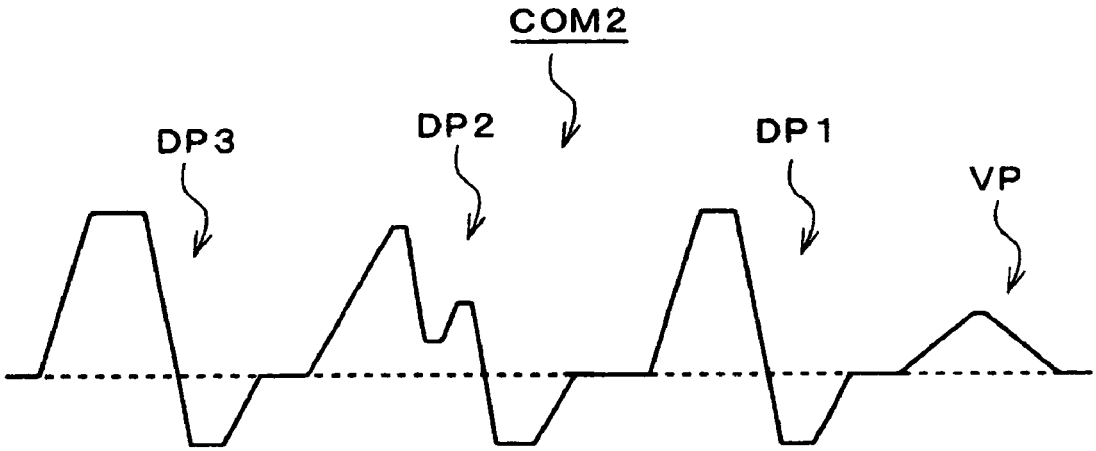

The driving signal generating circuit 43 generates various kinds of driving signals by the control of the control unit 41. In the present embodiment, the driving signal generating circuit 43 is configured such that a plurality of ejecting pulses which can form dots having different sizes are included in one record period (unit cycle) and a first driving signal COM1 in which the ejecting pulses are arranged in a predetermined sequence and a second driving signal COM2 in which the ejecting pulses are arranged in a sequence different from that of the first driving signal COM1 are generated. The first driving signal COM1, as illustrated in FIG. 4A, includes in series a first middle dot ejecting pulse DP1 for forming an middle dot, a small dot ejecting pulse DP2 for forming a small dot, a second middle dot ejecting pulse DP3 having an ejecting timing different from that of the first middle dot ejecting pulse DP1, and a minute vibration pulse VP which minutely vibrates such that the liquid surface (meniscus) exposed from the nozzle orifice 27 is not ejected. Furthermore, in the second driving signal COM2, as illustrated in FIG. 4B, the first middle dot ejecting pulse DP1 and the second middle dot ejecting pulse DP3 are arranged in a sequence opposite to the sequence of the first driving signal COM1. In other words, the second middle dot ejecting pulse DP3, the small dot ejecting pulse DP2, the first middle dot ejecting pulse DP1, and the minute vibration pulse VP are connected to one another in this sequence, thereby configuring the second driving signal COM2.

Figure 5A:
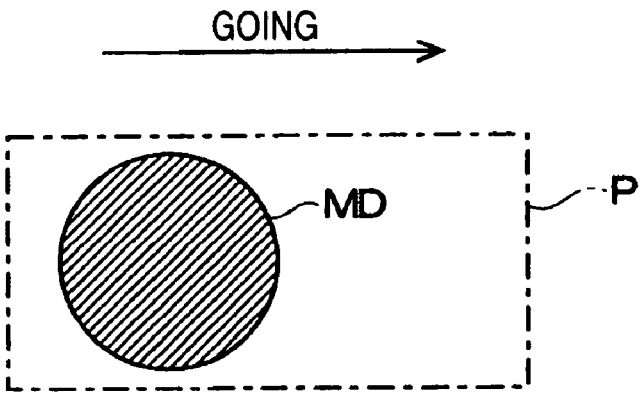
FIGS. 5A to 5C are views explaining an impact position of a middle dot at the time of going and returning.
Figure 5B:
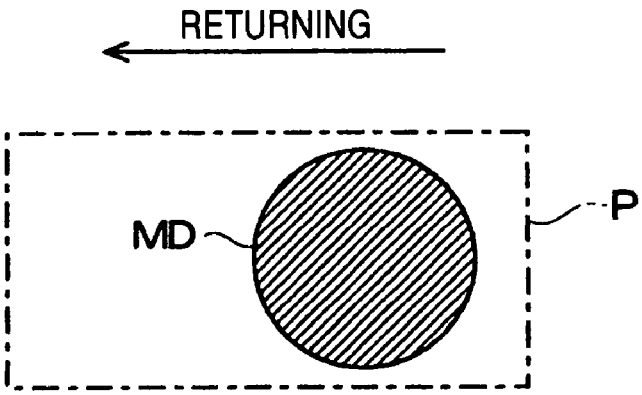
Figure 5C:
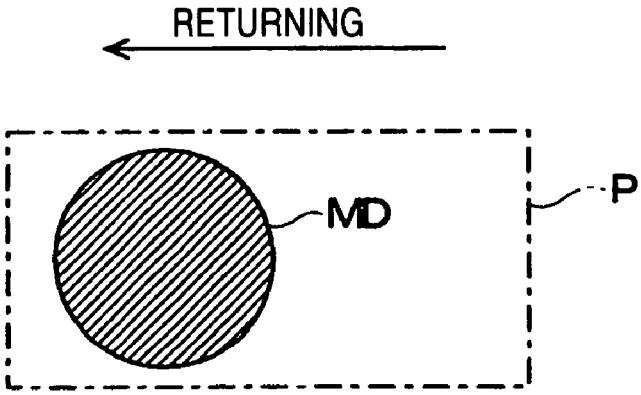

The first driving signal COM1 and the second driving signal COM2 are appropriately used at the time of going and returning of the record head 2. For example, when the driving signal generating circuit 43 generates the first driving signal COM1 at the time of the going of the record head 2, the second driving signal COM2 is generated at the time of the returning. On the contrary, when the second driving signal COM2 is generated at the time of the going, and the first driving signal COM1 is generated at the time of the returning. Thus, it is possible to suppress the positions of the middle dots which are impacted at the time of the going and returning from being deviated from each other in the main scan direction. For example, in a case where the middle dot is formed using the first middle dot ejecting pulse DP1, since the first middle dot ejecting pulse DP1 of the first driving signal COM1 is applied to the piezoelectric vibrator 17 at a fastest timing in one record period, when the middle dot MD is formed by the first driving signal COM1 at the time of the going, as illustrated in FIG. 5A, the middle dot is formed at a left side in a pixel P. When the middle dot MD is formed using the first driving signal COM1 at the time of the returning, as illustrated in FIG. 5B, the middle dot MD is formed a right side in the pixel P. Thus, the positions of the middle dots which are formed at the time of the going and returning are deviated from each other in the main scan direction. On the contrary, when the second driving signal COM2 is used at the time of the returning, since the first middle dot ejecting pulse DP1 is applied to the piezoelectric vibrator 17 at a slowest timing in one record period, as illustrated in FIG. 5C, the middle dot MD is formed at the left side in the pixel P. As the result, the positions of the middle dots which are formed at the time of the going and returning can become identical to each other in the main scan direction.

Furthermore, the first driving signal COM1 and the second driving signal COM2 are appropriately used based on the size of the paper gap, that is, the PG information. In more detail, when the paper gap is small, the driving signal generating circuit 43 generates the second driving signal COM2 at the time of the going and generates the first driving signal COM1 at the time of the returning. On the contrary, when the paper gap is large, the driving signal generating circuit 43 generates the first driving signal COM1 at the time of the going and generates the second driving signal COM2 at the time of the returning. Thus, in a case where a large dot is formed, when the paper gap is small, the impact accuracy more increases and thus higher image quality of the record image is accomplished and, when the paper gap is large, the affect of the mist is reduced. This will be described later in detail.

Next, a configuration of the print engine 36 will be described. The print engine 36 includes the record head 2, the carriage movement mechanism 7, the paper feed mechanism 8, the linear encoder 10, and the gap adjustment mechanism 46. The record head 2 includes a shift register SR 48, a latch 49, a decoder 50, a level shifter 51, a switch 52, and the piezoelectric vibrators 17 in plural in correspondence with the respective nozzle orifices 27. The ejecting data SI from the printer controller 35 is serially transmitted to the shift register 48 in synchronization with a clock signal CK from the oscillating circuit 42. The ejecting data is 2-bit data and is composed of gradation information representing record gradation (ejecting gradation) of four gradations including non-record (minute vibration), a small dot, a middle dot, and a large dot, in the present embodiment. In more detail, the non-record is set to gradation information "00", the small dot is set to gradation information "01", the middle dot is set to gradation information "10", and the large dot is set to gradation information "11".

The shift register 48 is connected with the latch 49, and, when a latch signal LAT from the printer controller 35 is input to the latch 49, the latch 49 latches the ejecting data of the shift register 48. The ejecting data latched in the latch 49 is input to the decoder 50. The decoder 50 translates 2-bit ejecting data and generates pulse selection data. This pulse selection data is configured by corresponding respective bits to the pulses which configure the driving signals COM1 and COM2. In addition, the supply and non-supply of the ejecting pulse to the piezoelectric vibrator 17 is selected in accordance with the contents of the respective bits, for example, "0" and "1". In more detail, for example, in the driving signal COM1, when the ejecting data is "01", that is, when the small dot is formed, the decoder 50 generates pulse selection data "0100". Moreover, when the ejecting data is "11", that is, when the large dot is formed, the decoder 50 generates pulse selection data "1010". Furthermore, when the middle dot is formed, two pulse selection data "1000" and "0010" are generated in accordance with the PG information from the control unit 41. In other words, the first middle dot ejecting pulse and the second middle dot ejecting pulse are appropriately used in accordance with the paper gap. This will be described later in detail.

In addition, the decoder 50 outputs the pulse selection data to the level shifter 51 by receiving the latch signal LAT or a channel signal CH. In this case, the pulse selection data is sequentially input to the level shifter 51 from an upper bit. This level shifter 51 functions as a voltage amplifier and outputs an electrical signal which is boosted to a voltage for driving the switch 52, for example, about several tens volts, when the pulse selection data is "1". The pulse selection data "1" boosted in the level shifter 51 is supplied to the switch 52. The input side of the switch 52 is supplied with the driving signals COM1 and COM2 from the driving signal generating circuit 43, and the output side of the switch 52 is connected with the piezoelectric vibrator 17.

Furthermore, the pulse selection data controls the operation of the switch 52, that is, the supply of the ejecting pulse of the driving signals to the piezoelectric vibrator 17. For example, during a time period when the pulse selection data input to the switch 52 is "1", the switch 52 is in the connection state and thus the corresponding ejecting pulse is supplied to the piezoelectric vibrator 17. Thus, the potential level of the piezoelectric vibrator 17 is changed depending on the waveform of the ejecting pulse. Meanwhile, during a time period when the pulse selection data is "0", the electrical signal for operating the switch 52 is not output from the level shifter 51. Accordingly, the switch 52 is in the disconnection state and thus the ejecting pulse is not supplied to the piezoelectric vibrator 17.

The decoder 50, the level shifter 51, the switch 52, and the control unit, all of which perform the above-mentioned operations select a necessary ejecting pulse from the driving signals based on the ejecting data to apply (supply) the ejecting pulse to the piezoelectric vibrator 17. As the result, the ink droplet of the amount according to the gradation information configuring the ejecting data is ejected from the nozzle orifice 27. Furthermore, in a case of the non-record gradation information, the minute vibration pulse VP is supplied to the piezoelectric vibrator 17 to generate the minute vibration of the meniscus. In addition, the pulse selection supplying means selects any one of the first middle dot ejecting pulse DP1 and the second middle dot ejecting pulse DP3 in accordance with the size of the paper gap (PG information) in a case of forming the middle dot on the record sheet 6. Hereinafter, this will be described.

Figure 6A:
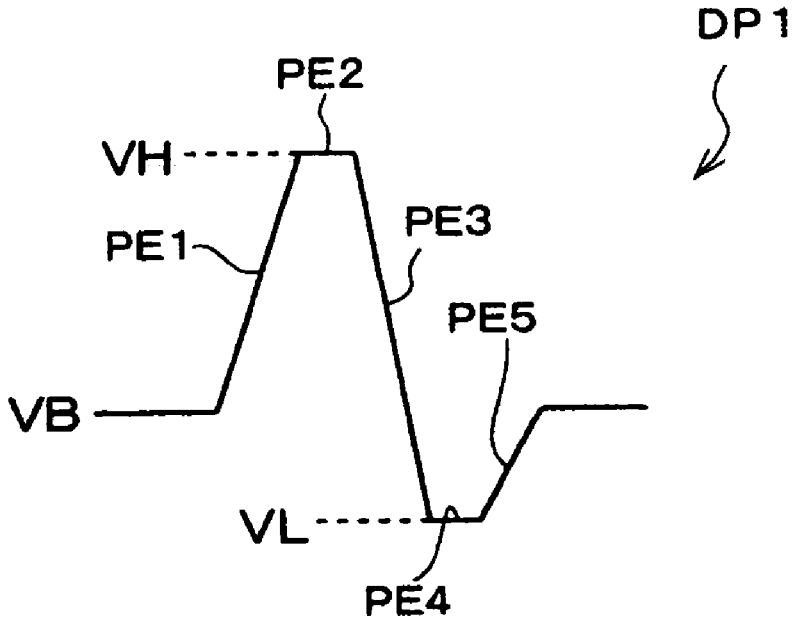
FIG. 6A is a waveform view explaining a configuration of a first middle dot ejecting pulse and FIG. 6B is a waveform view explaining a configuration of a second middle dot ejecting pulse.
Figure 6B:
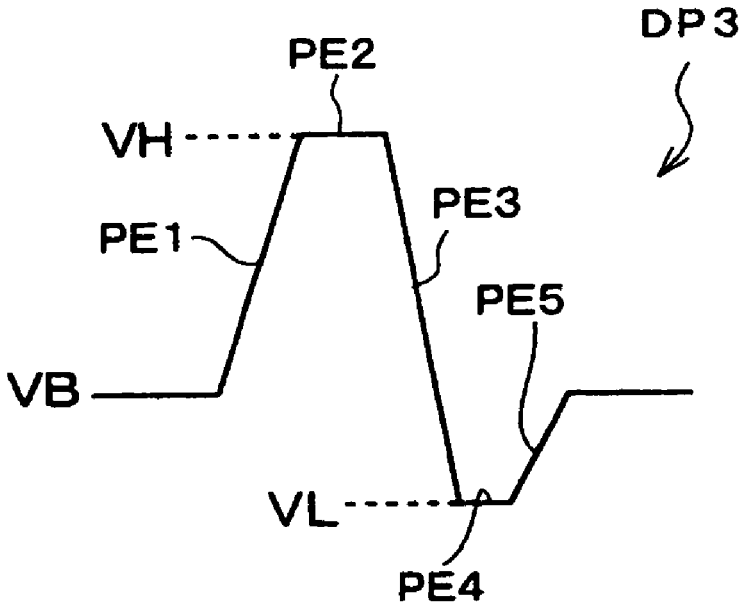

First, the configurations of the middle dot ejecting pulses DP1 and DP3 will be described. As shown in FIGS. 6A and 6B, each of the dot ejecting pulses DP1 and DP3 includes a first charging element PE1 which increases a reference potential (middle potential) VB to a highest potential VH in a relatively small gradient, a first hold element PE2 which holds the highest potential VH in a predetermined time (hereinafter, referred to as expansion hold time Pwh), an ejecting element PE3 which decreases the potential from the highest potential VH to a lowest potential VL in a large gradient, a second hold element PE4 which holds the lowest potential VL in a short time, and a second charging element PE5 which returns the potential from the lowest potential VL to the reference potential VB.

Here, the flight speed of the ink droplet is changed depending on the meniscus state at the ejecting timing, particularly, the tension of the meniscus. In other words, in the state that the meniscus is pulled toward the pressure chamber 25, the tension of the meniscus which moves in the ejecting direction (outside) is large. Thus, when the ink drop is ejected at a timing when the meniscus is located at the pressure chamber 25 rather than a reference position (the position of the meniscus in the stop state), the flight speed increases. This the same as a principle that the flight speed of an arrow when a bowstring is pulled farther back is larger than that of the arrow when the bowstring is pulled lightly back. On the contrary, in the state that the meniscus is pulled toward the outside, the meniscus moves toward the pressure chamber 25 (outside). Thus, when the ink drop is ejected at this timing, the flight speed decreases. Moreover, the middle dot ejecting pulses DP1 and DP3 are different from each other in the ejecting timing, that is, the timing when the ejecting element PE3 is applied to the piezoelectric vibrator 17, and thus in the flight speed of the ink droplet. The timing when the ejecting element PE3 is applied to the piezoelectric vibrator 17 is defined by the expansion hold time Pwh.

Figure 7:
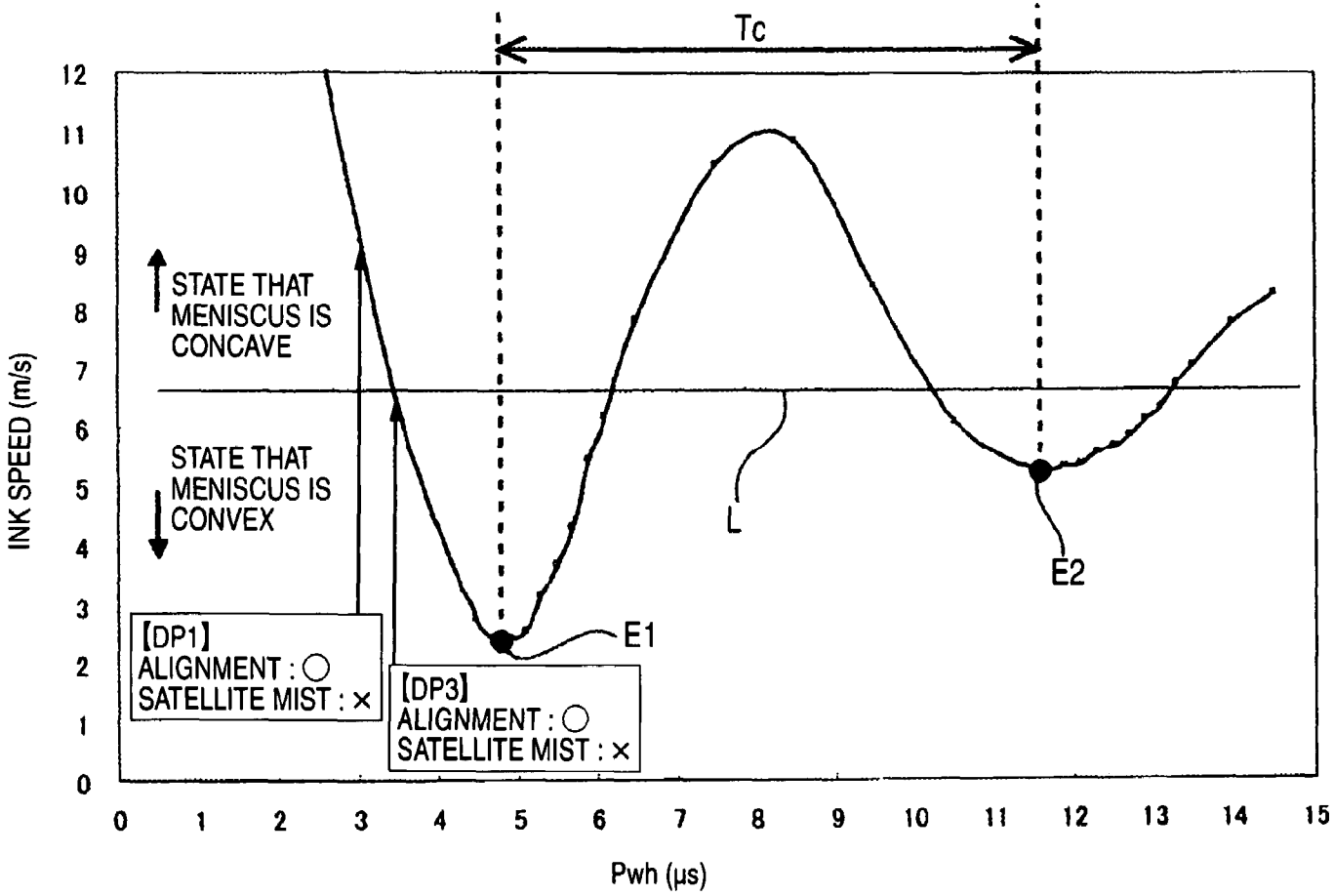
FIG. 7 is a graph illustrating a relationship between an expansion hold time and a flight speed of an ink droplet.

As shown in FIG. 7, since the state of the meniscus at the time of changing the pressure in the pressure chamber 25 is changed depending on a natural vibration period Tc of the ink in the pressure chamber 25, the change period of the flight speed of the ink droplet is identical to the natural vibration period Tc. In other words, the neutral line L of the amplitude in the graph illustrated in FIG. 7 corresponds to the reference position of the meniscus, and an interval between a minimum value E1 and a minimum value E2 corresponds to the natural vibration period Tc. In addition, when the ejecting element PE3 is applied to the piezoelectric vibrator 17 at a timing when the meniscus is located at a position that is closer to the pressure chamber 25 than the reference position (the state that the meniscus is concave), the flight speed of the ink droplet is relatively fast (above the neutral line L). Moreover, when the ejecting element PE3 is applied to the piezoelectric vibrator 17 at a timing when the meniscus is located at the outside of the reference position (the state that the meniscus is convex), the flight speed of the ink droplet is relatively slow (below the neutral line L).

Figure 8A:
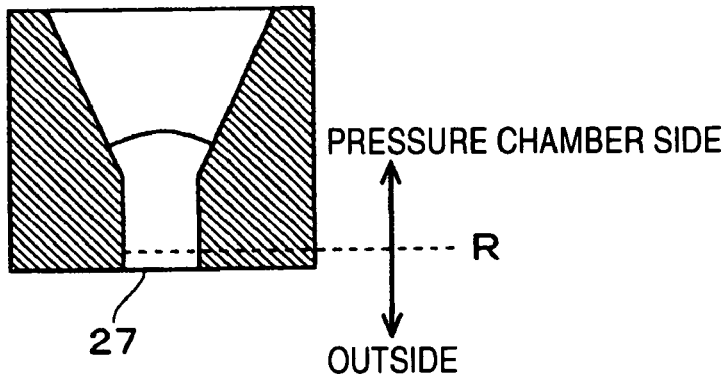
FIGS. 8A to 8C are views explaining the state change of a meniscus when an ink droplet is ejected using the first middle dot ejecting pulse.
Figure 8B:
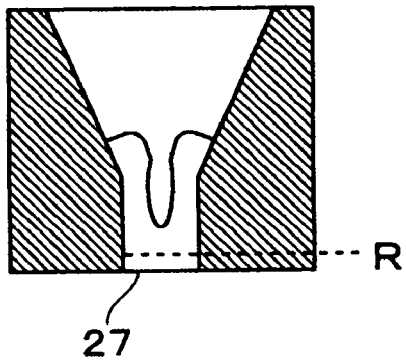
Figure 8C:
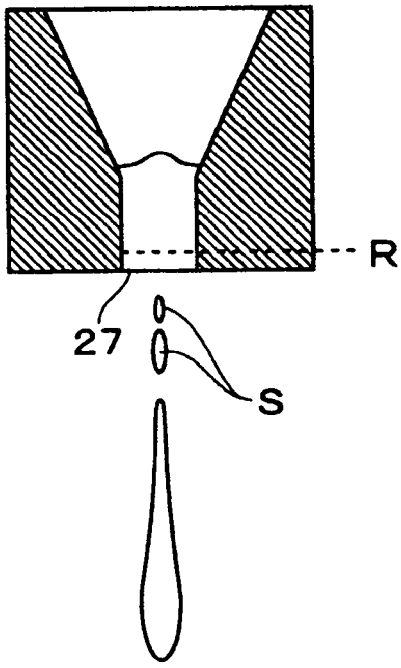

In the present embodiment, the expansion hold time Pwh of the first middle dot ejecting pulse DP1 is set to about 3 μs. When the first middle dot ejecting pulse DP1 is applied to the piezoelectric vibrator 17, the ink droplet is ejected as follows. In other words, when the first charging element PE1 is supplied, the piezoelectric vibrator 17 contracts, and the pressure chamber 25 expands. Accordingly, as illustrated in FIG. 8A, the meniscus is more pulled toward the pressure chamber 25. After the expansion state of the pressure chamber 25 is held in a very short time (3 μs), the ejecting element PE3 is applied at the timing when the meniscus is located at the position that is closer to the pressure chamber 25 than the reference position R and thus the piezoelectric vibrator 17 rapidly expand. Accordingly, the volume of the pressure chamber 25 contracts to be smaller than a reference volume (volume of the pressure chamber 25 at the time of applying the reference potential VB to the piezoelectric vibrator 17), and, as illustrated in FIG. 8B, the meniscus is rapidly pressed outward. Thus, as illustrated in FIG. 8C, the ink droplet of the amount which can form the middle dot is ejected from the nozzle orifice 27. Thereafter, the second hold element PE4 and the second charging element PE5 are sequentially supplied to the piezoelectric vibrator 17, and the pressure chamber 25 returns to the reference volume in order to converge the vibration of the meniscus according to the ejection of the ink droplet in a short time.

Since the flight speed of the ink droplet ejected by the first middle dot ejecting pulse DP1 is relatively fast as about 9 m/s as illustrated in FIG. 7, the vicinity of the nozzle orifice 27 is not wet or the shape unevenness is not easily affected and it is difficult to generate the flight bending. Accordingly, when the first middle dot ejecting pulse DP1 is used, it is possible to suppress the error of the impact position to a narrow range. On the contrary, as the flight speed increases, the ink droplet expands by the ejecting force, as shown in FIG. 8C, and the tail portion thereof is separated from the main portion, thereby generating a satellite ink droplet S (satellite liquid droplet). The satellite ink droplet S may become mist which floats in the air, since the satellite ink droplet S is not impacted onto the record sheet 6 when the distance to the record sheet 6, that is, the paper gap, is long.

Figure 9A:
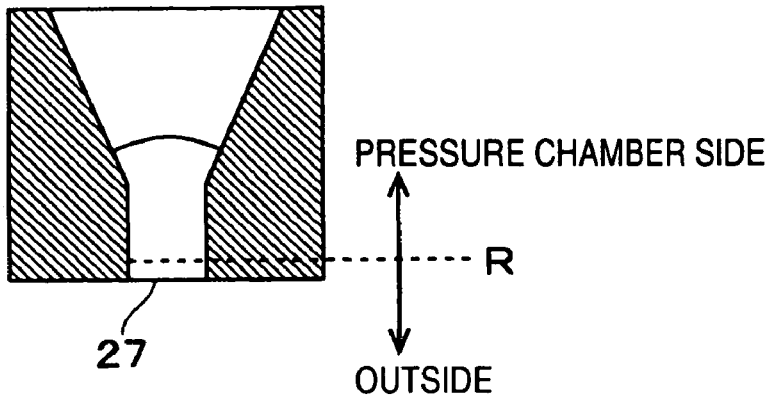
FIGS. 9A to 9C are views explaining the state change of a meniscus when an ink droplet is ejected using the second middle dot ejecting pulse.
Figure 9B:
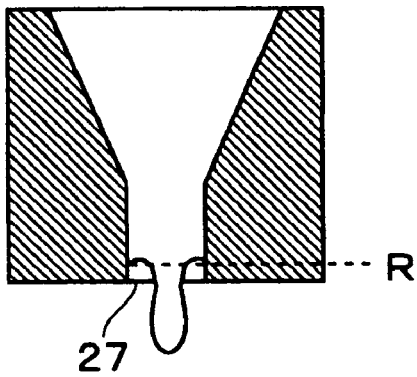
Figure 9C:
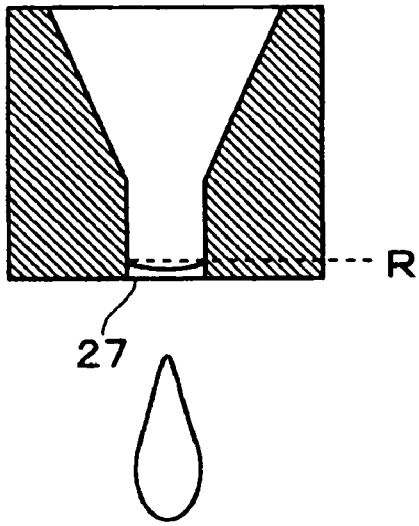

Meanwhile, in the second middle dot ejecting pulse DP3, the expansion hold time Pwh is set to about 3.4 μs. This is set such that the ink droplet is ejected at the timing the meniscus is located at a position that is further from the pressure chamber 25 than that of the first middle dot ejecting pulse DP1 after the first charging element PE1 is applied. When the second middle dot ejecting pulse DP3 is applied to the piezoelectric vibrator 17, the ink droplet is ejected as follows. In other words, when the first charging element PE1 is supplied, the piezoelectric vibrator 17 contracts, and the pressure chamber 25 expands. Accordingly, as illustrated in FIG. 9A, the meniscus is more pulled toward the pressure chamber 25. The expansion state of the pressure chamber 25 is held in a time (3 μs) longer than that of the first middle dot ejecting pulse DP1. At this time, the ink is introduced from the reservoir 23 into the pressure chamber 25, the meniscus moves outward, and, as illustrated in FIG. 9B, the charging element PE3 is applied at a timing when the meniscus is located at the reference position R (including a position where the meniscus slightly moves vertically) and thus the piezoelectric vibrator 17 rapidly expands. Accordingly, the volume of the pressure chamber 25 contracts to be smaller than the reference volume, and the meniscus is rapidly pressed outward. Thus, as illustrated in FIG. 9C, the ink droplet of the amount which can form the middle dot is ejected from the nozzle orifice 27. Thereafter, the second hold element PE4 and the second charging element PE5 are sequentially supplied to the piezoelectric vibrator 17, and the pressure chamber 25 returns to the reference volume in order to converge the vibration of the meniscus according to the ejection of the ink droplet in a short time.

As illustrated in FIG. 7, since the flight speed of the ink droplet ejected by the second middle dot ejecting pulse DP3 becomes about 6.5 m/s, which is slower than that of the first middle dot ejecting pulse DP1, the flight bending is apt to be generated. Accordingly, when the second middle dot ejecting pulse DP3 is used, the error of the impact position is larger than that of the first middle dot ejecting pulse DP1. In addition, the amount of the ink drop is more than that of the first middle dot ejecting pulse DP1. Meanwhile, since the ink droplet ejected by the second middle dot ejecting pulse DP3 has a slow speed, the tail portion thereof less expands than the first middle dot ejecting pulse DP1, and thus the satellite ink droplet is not apt to be generated.

In the printer 1, in a case of forming the middle dot, the middle dot ejecting pulses DP1 and DP3 are appropriately used in accordance with the size of the paper gap. In other words, in the case of forming the middle dot, the decoder 50, the level shifter 51, the switch 52, and the control unit 41 select the first middle dot ejecting pulse DP1 and form the middle dot, if the PG information is determined to a first state (PG: small) that the paper gap is small. Accordingly, it is possible to form the middle dot with good impact accuracy and to accomplish, for example, the high image quality of the record image. In addition, when the paper gap is small, although the satellite ink droplet is generated, the satellite ink droplet can be impacted onto the record sheet 6. Thus, the mist is not generated.

Furthermore, in a case of forming the middle dot, when the PG information is determined to a second state (PG: large) that the paper gap is large, the decoder 50, the level shifter 51, the switch 52, and the control unit 41 selects the second middle dot ejecting pulse DP3 to form the middle dot. The ink droplet ejected by the second middle dot ejecting pulse DP3 does not easily generate the satellite ink droplet as described above, the middle dot can be formed without generating the mist, although the paper gap is large.

Figure 10A:
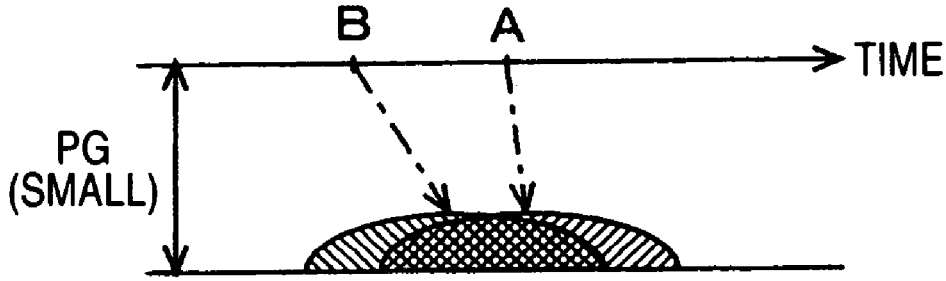
FIG. 10A is a view explaining the formation of a large dot in a first state and FIG. 10B is a view explaining the formation of a large dot in a second state.

Next, a case of forming the large dot will be described. When the large dot is formed, all the middle dot ejecting pulses DP1 and DP3 are applied to the piezoelectric vibrator 17, but, in the present embodiment, the sequence of supplying the ejecting pulses DP1 and DP3 to the piezoelectric vibrator 17 may be changed depending on the PG information, that is, the size of the paper gap. In more detail, in a case of the first state (PG: small) that the paper gap is small, the driving signal generating circuit 43 generates the second driving signal COM2 in which the first middle dot ejecting pulse DP1 is disposed after the second middle dot ejecting pulse DP3. Accordingly, when the large dot is formed in the first state, the second middle dot ejecting pulse DP3 and the first middle dot ejecting pulse DP1 are sequentially supplied to the piezoelectric vibrator 17. Thus, as illustrated in FIG. 10A, the ink droplet is first ejected by the second middle dot ejecting pulse DP3 and the ejecting droplet is then ejected by the first middle dot ejecting pulse DP1.

Here, since the ink droplet is ejected while the record head 2 moves in the main scan direction, an inertia component due to the movement of the record head 2 is applied to the ejected ink droplet and thus the ink droplet obliquely fly with respect to the record sheet 6. Particularly, since the flight speed of the ink droplet ejected by the second middle dot ejecting pulse DP3 is slower than that of the first middle dot ejecting pulse DP1 and thus the flight time thereof becomes longer, the ink droplet is impacted at a position separated from the ejected position in the movement direction of the record head 2. On the contrary, since the flight speed of the ink droplet ejected by the first middle dot ejecting pulse DP1 is higher than that of the ink droplet ejected by the second middle dot ejecting pulse DP3 and thus the flight speed thereof becomes slower, the ink droplet is impacted at a position close to a position just below the ejected position. Accordingly, when the ink droplets are ejected in the order of the second middle dot ejecting pulse DP3 and the first middle dot ejecting pulse DP1, as illustrated in FIG. 10A, the impact positions of the ink droplets are adjacent to each other and thus the large dot which is not largely spread can be formed. As the result, it is possible to accomplish the high image quality of the record image. In addition, since the ink droplet ejected by the first middle dot ejecting pulse DP1 has a short flight time in the first state, the mist is not apt to be generated although the flight speed is fast. The ink droplet ejected by the second middle dot ejecting pulse DP3 has the flight time longer than that of the ink droplet ejected by the first middle dot ejecting pulse DP1, but the flight speed is relatively slow and thus the mist is not apt to be generated. Thus, the large dot can be formed while efficiently suppressing the mist to be generated.

Figure 10B:
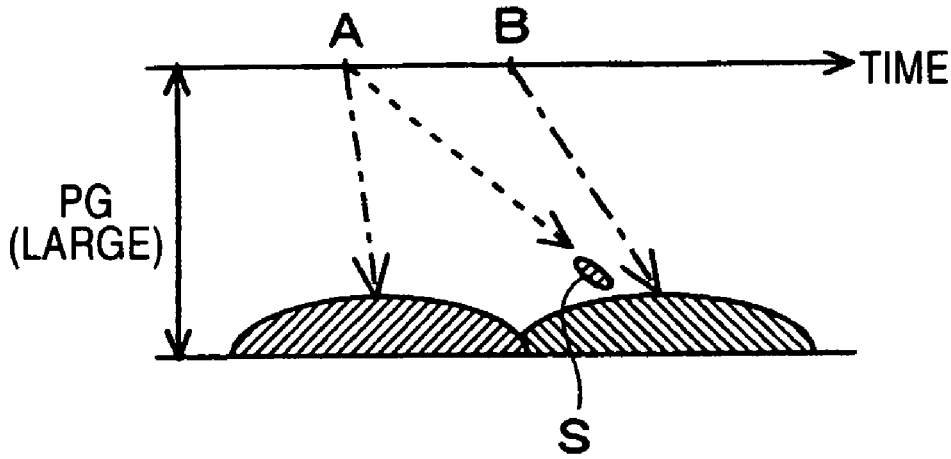

Furthermore, in a case of the second state (PG: large) that the paper gap is large, the driving signal generating circuit 43 generates the first driving signal COM1 in which the first middle dot ejecting pulse DP1 is disposed prior to the second middle dot ejecting pulse DP3. Accordingly, when the large dot is formed in the second state, the first middle dot ejecting pulse DP1 and the second middle dot ejecting pulse DP3 are sequentially supplied to the piezoelectric vibrator 17. Thus, as illustrated in FIG. 10B, the ink droplet is first ejected by the first middle dot ejecting pulse DP1 and the ejecting droplet is then ejected by the second middle dot ejecting pulse DP3. In this case, in opposition to the first state, the impact positions of the ink drops are spaced apart from each other and thus the large dot which more expands than that of the first state in the main scan direction is formed. However, in this case, since the satellite ink droplet S attached to the ink droplet ejected by the first middle dot ejecting pulse DP1 is, as illustrated in FIG. 10B, absorbed into the ink droplet ejected by the second middle dot ejecting pulse DP3, it is possible to suppress the mist to be generated. By setting the flight speed or the weight of the ink droplet of the satellite ink droplet S to be smaller than that of the ink droplet ejected by the first middle dot ejecting pulse DP1, the satellite ink droplet flies toward a position different from the impact position of the ink droplet ejected by the first middle dot ejecting pulse DP1, and more particularly, the impact position direction of the ink droplet ejected by the second middle dot ejecting pulse DP3, and, by adjusting the flight speed of the satellite ink droplet S in consideration of the flight speed, the flight direction, or the impact position of the ink droplet ejected by the second middle dot ejecting pulse DP3, the satellite ink droplet S is absorbed into the ink droplet ejected by the second middle dot ejecting pulse DP3, thereby suppressing the mist to be generated.

As described above, since the ink droplet ejected by the first middle dot ejecting pulse DP1 selected in the first state that the paper gap is small has the relatively high flight speed, it is difficult to generate the flight bending. Thus, when the middle dot is formed in the first state, it is possible to ensure higher impact accuracy. Since the ink droplet ejected by the second middle dot ejecting pulse DP3 selected in the second state that the paper gap is large has the flight speed slower than that of the ink droplet ejected by the first middle dot ejecting pulse DP1, it is difficult to generate the satellite ink droplet. Thus, when the middle dot is generated in the second state, it is possible to suppress the mist from being generated and thus to prevent the failure due to the mist.

Furthermore, in a case where the large dot is formed in the first state, when the ink droplet is ejected by sequentially applying the second middle dot ejecting pulse DP3 and the first middle dot ejecting pulse DP1 to the piezoelectric vibrator 17, the impact positions of the ink droplets are adjacent to each other and thus the large dot can be formed with good accuracy. In addition, in a case where the large dot is formed in the second state, when the ink droplet is ejected by sequentially applying the first middle dot ejecting pulse DP1 and the second middle dot ejecting pulse DP3 to the piezoelectric vibrator 17, the satellite ink droplet attached to the ink droplet ejected by the first middle dot ejecting pulse DP1 is absorbed into the ink droplet ejected by the second middle dot ejecting pulse DP3 and thus the mist can be suppressed from being generated.

However, although, in the present embodiment, two steps using the first state that the paper gap is small and the second state that the paper gap is large are described with respect to the paper gap, the concept of the first state and the second state is not limited to the two steps. For example, in a case of setting the paper gap to three steps or more, a predetermined state (size) of the paper gap becomes a reference state, the concept that the state smaller than the reference state is the first state and the state larger than the reference state is the second state is included. In other words, for example, in a small state that the paper gap is a minimum and a middle state that the paper gap is slightly larger than the minimum (that is, between the minimum and a maximum), the first middle dot ejecting pulse DP1 is used when the middle dot is formed, and, in a large state that the paper gap is larger than that of the middle state, the second middle dot ejecting pulse DP3 is used. In this case, the small state and the middle state correspond to the first state and the large state corresponds to the second state.

In addition, the present invention is not limited to the above-mentioned embodiment and may be variously changed based on claims. For example, the waveform of the ejecting pulse is not limited to the above-mentioned embodiment. A waveform, which includes waveform elements corresponding to an expansion element for expanding the pressure chamber and an ejecting element for contracting the pressure chamber and ejecting the liquid droplet and changes the timing of applying the ejecting element, may apply to the present invention.

Moreover, although, in the above-mentioned embodiment, the piezoelectric vibrator 17 of the longitudinal vibration mode is described as the pressure generating element of the present invention, the present invention is not limited to this. For example, the pressure generating element may be a piezoelectric vibrator which can vibrate in an electric field direction (lamination direction of a piezoelectric body and an internal electrode). In addition, the present invention is not limited to the piezoelectric vibrator which is unified in each nozzle row, and may be provided in each pressure chamber 25, like a piezoelectric vibrator of a bending vibration mode. Furthermore, the pressure generating element is not limited to the piezoelectric vibrator, and the other pressure generating element such as a heating element may be used.

In addition, the present invention can apply to other liquid ejecting apparatus than the printer. For example, the present invention can apply to a display manufacturing apparatus, an electrode manufacturing apparatus, and a chip manufacturing apparatus.

What is claimed is:

1. A liquid ejecting apparatus comprising:

a liquid ejecting head, comprising:

a nozzle formation face, formed with a nozzle orifice;

a pressure chamber, communicated with the nozzle orifice, and adapted to contain liquid therein; and a pressure generator, operable to cause pressure change in the pressure chamber so as to eject the liquid in the pressure chamber from the nozzle orifice to a target medium as a liquid droplet;

an adjuster, operable to adjust a distance between the nozzle formation face and the target medium so as to be at least a first distance and a second distance that is longer than the first distance;

a driving signal generator, operable to generate a driving signal that includes:

a first pulse having at least a first expansion element for causing the pressure generator to expand the pressure chamber and a first ejecting element for causing the pressure generator to contract the pressure chamber to eject a liquid droplet having a prescribed volume; and a second pulse having at least a second expansion element for causing the pressure generator to expand the pressure chamber and a second ejecting element for causing the pressure generator to contract the pressure chamber to eject a liquid droplet having the prescribed volume; and a pulse supplier, operable to selectively supply the first pulse and the second pulse to the pressure generator, wherein the first pulse is configured such that the first ejecting element is applied to the pressure generator when a meniscus of the liquid is located at a first position that is closer to the pressure chamber than a reference position after the first expansion element is applied to the pressure generator, the second pulse is configured such that the second ejecting element is applied to the pressure generator when the meniscus is located at a second position that is farther from the pressure chamber than the first position after the second expansion element is applied to the pressure generator, and the pulse supplier, in order to eject the liquid droplet having the prescribed volume, selects the first pulse when the distance is the first distance, and selects the second pulse when the distance is the second distance.

2. The liquid ejecting apparatus according to claim 1, wherein the second position is identical with the reference position.

3. The liquid ejecting apparatus according to claim 1, wherein the first pulse further includes a first holding element for holding a state of the pressure chamber expanded by the first expansion element for a first time period, and the second pulse further includes a second holding element for holding a state of the pressure chamber expanded by the second expansion element for a second time period that is longer than the first time period.

4. The liquid ejecting apparatus according to claim 1, wherein the driving signal commonly includes the first pulse and the second pulse within a unit cycle thereof.

5. The liquid ejecting apparatus according to claim 4, wherein the driving signal generator generates the first pulse after the second pulse when the distance is the first distance, and generates the first pulse prior to the second pulse when the distance is the second distance.

* * * * *